US007975326B1

(12) United States Patent
Wilson

(10) Patent No.: US 7,975,326 B1
(45) Date of Patent: Jul. 12, 2011

(54) DISPOSABLE LINERS FOR A CHILD'S POTTY CHAIR

(76) Inventor: Barbara Wilson, Calumet City, IL (US)

( * ) Notice: Subject to any disclaimer, the term of this patent is extended or adjusted under 35 U.S.C. 154(b) by 330 days.

(21) Appl. No.: 12/251,846

(22) Filed: Oct. 15, 2008

Related U.S. Application Data

(60) Provisional application No. 60/979,953, filed on Oct. 15, 2007.

(51) Int. Cl.
*A47K 11/06* (2006.01)

(52) U.S. Cl. ..... 4/484; 4/452; 4/902; 4/451

(58) Field of Classification Search ..... 4/484, 452, 4/902, 451
See application file for complete search history.

(56) References Cited

U.S. PATENT DOCUMENTS

| | | | | |
|---|---|---|---|---|
| 4,759,086 | A * | 7/1988 | Booth-Cox | 4/452 |
| 4,882,794 | A * | 11/1989 | Stewart, III | 4/452 |
| 6,523,187 | B1 * | 2/2003 | Brink et al. | 4/484 |
| 6,532,605 | B1 * | 3/2003 | Howell | 4/484 |
| 6,738,991 | B1 * | 5/2004 | Dandreo et al. | 4/484 |
| 7,409,731 | B1 * | 8/2008 | Arteaga et al. | 4/484 |
| 2003/0159207 | A1 * | 8/2003 | Howell | 4/484 |
| 2005/0188455 | A1 * | 9/2005 | Sharp | 4/484 |
| 2006/0080767 | A1 * | 4/2006 | Dombe-Korody et al. | 4/484 |
| 2006/0080768 | A1 * | 4/2006 | Smith, Jr. | 4/484 |
| 2007/0151014 | A1 * | 7/2007 | Samuels | 4/484 |
| 2007/0271691 | A1 * | 11/2007 | Cortez | 4/484 |

FOREIGN PATENT DOCUMENTS

GB 2196246 A * 4/1988

* cited by examiner

*Primary Examiner* — Khoa D Huynh
(74) *Attorney, Agent, or Firm* — Cook Alex Ltd.

(57) ABSTRACT

A disposable liner for a child's potty chair includes a generally flexible sheet material, a pouch portion formed near the center of the sheet material to extend downwardly into the opening of the potty chair, an absorbent material disposed in the pouch, a plurality of outwardly extending portions extending laterally from the sheet material, and an adhesive material disposed on an underside surface of the outwardly extending portions to adhere the disposable liner to the seat portion of the potty chair. A pull string may be disposed around the pouch, such that the pull string may be pulled after the disposable liner is used to close the pouch portion.

10 Claims, 2 Drawing Sheets

DISPOSABLE LINERS FOR A CHILD'S POTTY CHAIR

CROSS-REFERENCE TO RELATED PATENT APPLICATION

This non-provisional patent application claims a right of priority to U.S. provisional patent application Ser. No. 60/979,953, filed on Oct. 15, 2007.

FIELD OF THE INVENTION

The present invention relates generally to disposable liners for a child's potty chair.

BACKGROUND OF THE INVENTION

Beginning at about one and one-half years old, many parents begin training a child to use a potty chair to learn adult bathroom behavior and to wean the child off of diapers. Children of such a young age often have a fear of using conventional adult-sized toilets. This fear is probably caused by concerns relating to the size of the opening of the seat on the toilet, concerns relating to the depth of the bowl of a toilet, as well as to concerns relating to the height of the toilet. Adapter rings which fit onto the seat of the toilet to reduce the size of the opening for children are known. However, many children are still afraid of the depth of the hole below the adapter ring, that is, the depth of the bowl of the toilet. Thus, such adapter rings find limited success and limited use.

Thus, most parents utilize a child's potty chair. Such chairs are of a miniature size suitable for a small child. The opening in the center of the chair seat is also sized for a small child. Disposed below the seat of the chair and below the opening is a pan in the form of a small pot with generally cylindrical sides and a generally flat bottom. The depth of the pan is usually in a range of about three to six inches. The pan usually slides in from one of the sides or from the back and is held in place below the seat by slides attached to the underside of the seat.

While such potty chairs are suitable for their intended purpose, unlike conventional adult toilets, potty chairs are not self-cleaning. Thus, after each use, the parent must empty the urine and/or feces from the pan, and then, rinse or clean the pan. Of course, transfer of the urine or feces from the potty chair to a toilet sometimes results in an accidental spill thereof, which necessitates an unpleasant clean-up task.

Other problems also arise from the use of potty chairs. For example, especially with male children, urine may be directed into the gap between the underside of the seat and the top edge of the pan during urination. Depending upon the design of the potty chair, this frequently results in urine escaping from the potty chair onto the floor. This results in frustration for both the parent and the child.

A general object of the present invention is to therefore provide a liner for a potty chair which avoids the problems of spillage and accidental urine loss.

Another object of the present invention is to provide a liner for a potty chair which adhesively attaches to the seat of the potty chair.

A further object of the present invention is to provide a liner for potty chair which has a formed pouch which extends downwardly into the pan of the potty chair.

Yet another object of the present invention is to provide a liner for a potty chair which has an absorbent material disposed in the pouch for absorbing urine.

A still further object of the present invention is to provide a liner for a potty chair which has a pull string disposed near the periphery of the liner such that the liner may be conveniently closed after use and for disposal.

SUMMARY OF THE INVENTION

The present invention is directed to a disposable liner for a child's potty chair of the type having an opening in a seat portion thereof. The disposable liner includes a generally flexible sheet material, a pouch portion formed near the center of the sheet material to extend downwardly into the opening of the potty chair, an absorbent material disposed in the pouch, a plurality of outwardly extending portions extending laterally from the sheet material, and an adhesive material disposed on an underside surface of the outwardly extending portions to adhere the disposable liner to the seat portion of the potty chair.

The generally flexible sheet material is preferably moisture impervious and may be a plastic material. An adhesive material is preferably disposed on an underside surface of the outwardly extending portions, and the adhesive material is initially covered by removable tabs.

The pouch portion of the disposable liner has a bottom and a generally cylindrical sidewall, and the absorbent material is disposed in the bottom of the pouch portion. For example, the absorbent material may be a paper pulp material for absorbing any urine deposited in the pouch portion. The absorbent material may also be disposed along the generally cylindrical sidewall of the pouch portion. Alternatively, the pouch portion may have a continuously curving sidewall and the absorbent material is disposed along the continuously curving sidewall. For example, the pouch portion may be of generally hemispherical shape.

The disposable liner may further include an elongated pocket formed between the outwardly extending portions of the sheet material and the pouch portion, and a pull string disposed in the elongated pocket, such that the pull string may be pulled after the disposable liner is used to close the pouch portion.

BRIEF DESCRIPTION OF THE DRAWINGS

The invention, together with its objects and the advantages thereof, may best be understood by reference to the following description taken in conjunction with the accompanying drawings, in which like reference numerals identify like elements in the figures, and in which.

DESCRIPTION OF THE PREFERRED EMBODIMENTS

It will be understood that the present invention may be embodied in other specific forms without departing from the spirit thereof. The present examples and embodiments, therefore, are to be considered in all respects as illustrative and not restrictive, and the invention is not to be limited to the details presented herein.

Figure 1:
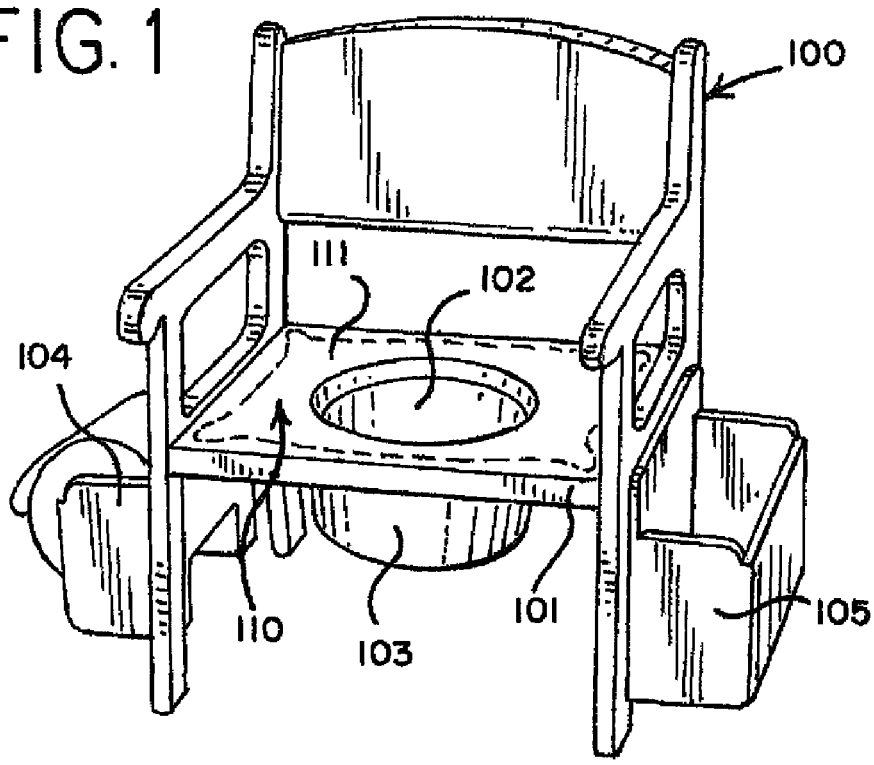
FIG. 1 is a perspective view of a potty chair with a disposable liner installed thereon in accordance with the present invention.

With reference to FIG. 1, there is shown a child's potty chair 100 with a generally horizontally disposed seat 101. Seat 101 has a hole or aperture 102 located generally in the center of the seat. Disposed below the center of the seat 101 is a pan 103 which is typically used to collect urine and/or feces from a child. In the depiction of FIG. 1, seat 100 is also equipped with a toilet roll dispenser 104 attached to one side of seat 100, and a waste basket 105 or the like attached to an opposite side of seat 100.

In accordance with one aspect of the present invention, a liner 110, shown in broken lines in FIG. 1 is installed on the potty chair 100. Liner 110 has a perimeter portion 111 which extends over a portion of seat 101 when the liner 110 is installed on the potty chair 100. Liner 110 may be installed on the seat 101 of the potty chair 100 with or without the pan 103 installed under the seat.

Figure 2:
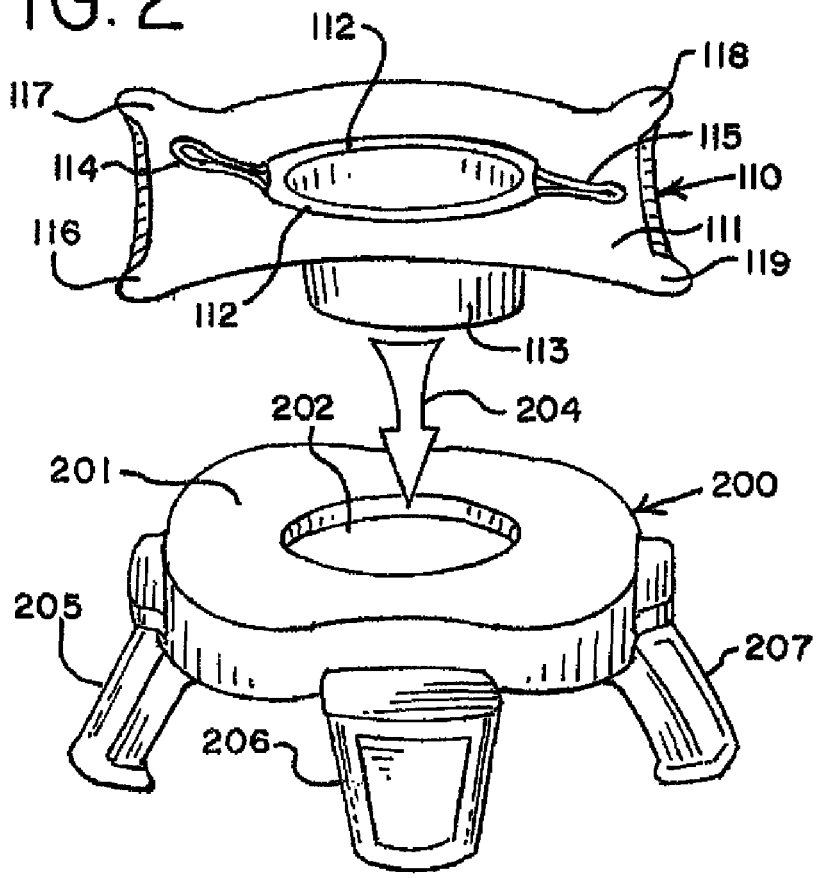
FIG. 2 is a perspective view of a different style potty chair, in the form of a stool, with a disposable liner ready to be installed thereon in accordance with another aspect of the present invention.

Some potty chairs are currently available in the form of a stool. FIG. 2 shows such a stool 200, which has a generally circular seat 201 with an aperture 202 disposed in the center of the seat 201. Stool 200 is supported by a plurality of legs, such as by legs 205-207. While not shown in FIG. 2, stool 200 is also normally equipped with a pan, such as a pan similar to pan 103 in FIG. 1. As used herein, the expression "potty chair" will be understood to encompass and include such stools 200 and other variants of chairs.

As indicated by a downwardly pointing arrow 204 in FIG. 2, liner 110 may be deposited downwardly onto the seat 201 of stool 200, such that the pouch 113 of liner 110 is disposed in aperture 202 in the seat 201, with most of pouch 113 disposed below aperture 202. The perimeter 111 of liner 100 then covers a portion of the seat 201. Liner 110 preferably has a plurality of outwardly extending portions 116-119. At least some of outwardly extending portions 116-119 have an adhesive 128 and 129 disposed on the underside of portions 116-119 to retain the perimeter 111 onto the seat 101 or 201. This adhesive 128-129 is preferably covered before use with peel-able tabs 126-127. Just before use, peel-able tabs 126 and 127 are removed to expose the adhesive. When liner 110 is placed against the seat of the potty chair with the adhesive exposed, liner 110 will be held in place until it is removed.

Figure 3:
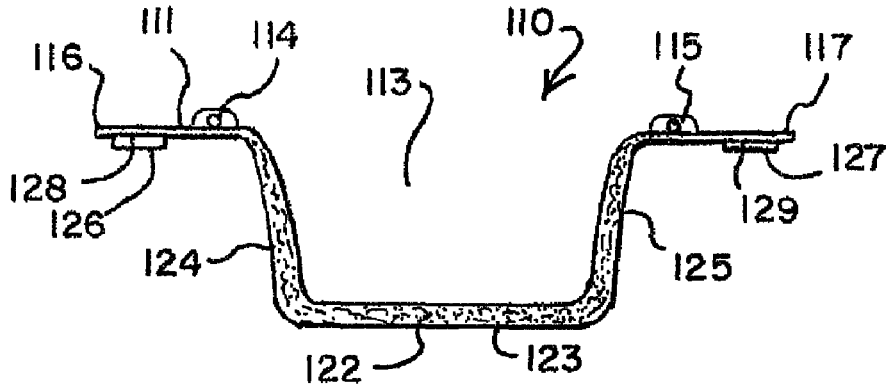
FIG. 3 is a cross-sectional view of a disposable liner with absorbent material disposed in the bottom of the liner and along the walls of the liner in accordance with the present invention.

A cross-sectional view of liner 110 is shown in FIG. 3. Liner 110 preferably consists of a flexible material, such as a plastic sheet material. A pouch 113 is defined near the center of the liner. Pouch 113 is sized to fit into the opening in the seat of the potty chair 100 or 200 and to extend downwardly into the aperture 102 or 202. For example, pouch 113 may be about 5 to 8 inches in diameter and about 3 to 6 inches deep. Preferably, pouch 113 has absorbent pad material 122 formed about the bottom 123 of the pouch 113 and along the sidewalls 124 and 125 of the pouch, with the absorbent pad material 122 terminating near the peripheral portion 111. For example, the absorbent pad material 122 may be a paper pulp material, or the like. One of the purposes of the absorbent pad material is to absorb any urine secreted into the liner 110.

In accordance with another aspect of the present invention, as shown in FIGS. 2-5, a pull string 114-115 is preferably disposed in an elongated pocket 112 about the peripheral portion, such as about the pouch 113. For example, elongated pocket 112 can be formed by bonding a strip of plastic material along the edges to the peripheral portion 111. Thus, when the liner 110 is removed from the potty chair 100 or 200, the pull strings 114-115, which are disposed on opposite sides of pouch 113, may be used to close the pouch 113, including any urine and/or feces contained therein. The liner 110 may then be conveniently disposed of without encountering unwanted odors or the like, and without encountering any accidental spillage of the contents contained in the pouch of the liner.

Figure 4:
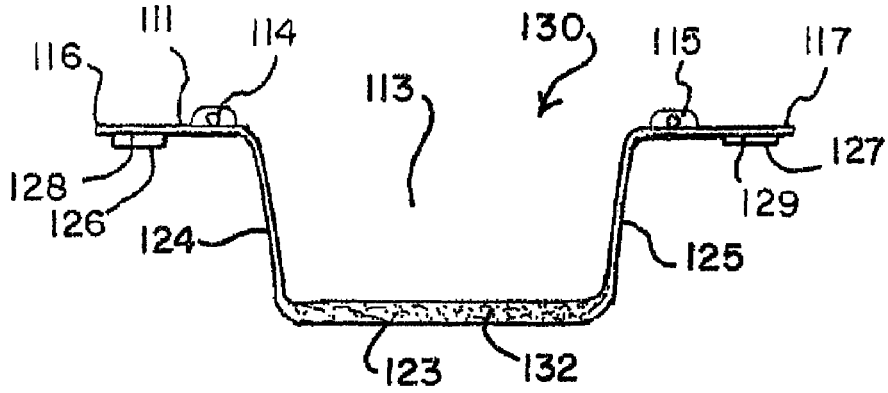
FIG. 4 is a cross-sectional view of a disposable liner with absorbent material disposed mostly in the bottom of the liner in accordance with the present invention.

In another embodiment of the present invention, FIG. 4 shows a cross-section of a liner 130. Liner 130 is similar in construction to liner 110. However, liner 130 has most of absorbent pad material 132 disposed on the inside of pouch 113 along the bottom 123 of liner 130, with little to none of the absorbent pad material 132 disposed along the sidewalls 124-125. Liner 130 may thus be more economical to manufacture than liner 110. Liner 130 may therefore satisfy more price conscious purchasers.

Figure 5:
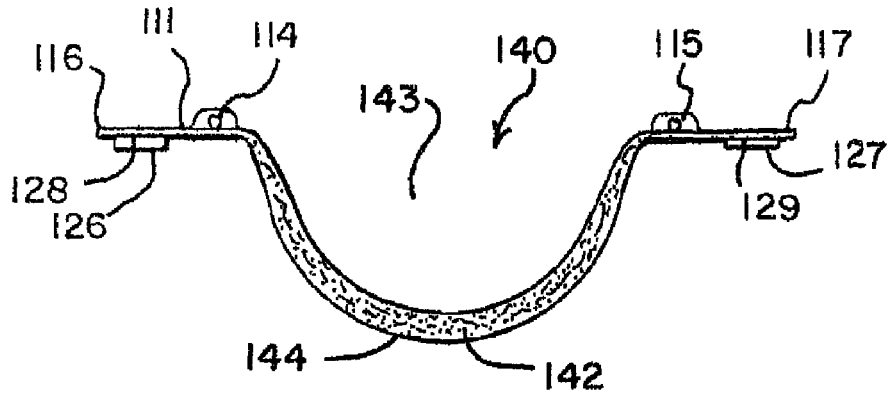
FIG. 5 is a cross-sectional view of a disposable liner with the bottom of the liner having more curved wall and bottom surfaces in accordance with the present invention.

In a further embodiment of the present invention, FIG. 5 shows a cross-section of a liner 140. In comparison with liner 110 in FIGS. 1-3 and liner 130 in FIG. 4, it will be appreciated that the walls 144 of liner 140 are more curved than the corresponding sidewalls 124-125 and bottom 123 of liners 110 or 130. As a result, the walls 144, which also define the pouch 143 of liner 140, are less of the general cylindrical shape of sidewalls 124-125 and less of the generally planar shape of bottom 123. Thus, the depth of pouch 143 varies. In essence, the walls 144 of liner 140 may be continuously curved and/or may be partially spherical in shape. Of course, it will be appreciated by those skilled in the art that the shape of the sidewalls and bottom of a liner may assume any shape between that of the well-defined sidewalls 124-125 and bottom 123 of liners 110 and 130 and the more curved walls 144 of liner 140.

Preferably, the liners 110 and 130 are lightly scented for freshness and to assist in masking the odors associated with feces and urine. For example, the liners 110 and 130 may be provided with a lemon scent or a baby powder scent.

While particular embodiments of the invention have been shown and described, it will be obvious to those skilled in the art that changes and modifications may be made therein without departing from the invention in its broader aspects.

The invention claimed is:

1. A disposable liner for a child's potty chair, the potty chair having an opening in a seat portion thereof, said disposable liner comprising:

a generally flexible sheet material;

a pouch portion formed near the center of the sheet material to extend downwardly into the opening of the potty chair;

an absorbent material disposed in the pouch portion;

an elongated and circular pocket formed about the pouch portion;

a pull string disposed in the elongated pocket, the pull string for closing the pouch portion of the disposable liner after use;

a plurality of outwardly extending portions of the sheet material extending laterally beyond the elongated pocket and beyond the pouch portion, said outwardly extending portions forming a portion of the periphery of the disposable liner;

an adhesive material disposed on an underside surface of the outwardly extending portions to adhere the disposable liner to a seat portion of the potty chair;

removable tabs initially covering said adhesive material, the removable tabs removable to install and affix of the disposable liner to the seat of the potty chair.

2. The disposable liner in accordance with claim 1 wherein the generally flexible sheet material is moisture impervious.

3. The disposable liner in accordance with claim 1 wherein the generally flexible sheet material is a plastic material.

4. The disposable liner in accordance with claim 1 wherein the pouch portion has a bottom and a generally cylindrical sidewall and the absorbent material is disposed in the bottom of the pouch portion.

5. The disposable liner in accordance with claim 4 wherein the absorbent material is also disposed along the generally cylindrical sidewall of the pouch portion.

6. The disposable liner in accordance with claim 1 wherein the pouch portion has a continuously curving sidewall and the absorbent material is disposed along the continuously curving sidewall of the pouch portion.

7. The disposable liner in accordance with claim 6 wherein the pouch portion is of generally hemispherical shape.

8. The disposable liner in accordance with claim 1 wherein the absorbent material is a paper pulp material for absorbing any urine deposited in the pouch portion.

9. The disposable liner in accordance with claim 1 wherein the disposable liner is lightly scented.

10. The disposable liner in accordance with claim 9 wherein the scent is lemon or baby powder.

* * * * *